United States Patent [19]

Oger

[11] 3,977,124

[45] Aug. 31, 1976

[54] MAN-HOLE ASSEMBLY

[75] Inventor: Jacques Oger, Pont-a-Mousson, France

[73] Assignee: Pont-A-Mousson S.A., Nancy, France

[22] Filed: Feb. 28, 1975

[21] Appl. No.: 554,327

[30] Foreign Application Priority Data

Apr. 19, 1974 France ..... 74.13678

[52] U.S. Cl. ..... 49/463; 49/465

[51] Int. Cl.[2] ..... E06B 3/32; E05C 21/02

[58] Field of Search ..... 49/463, 464, 465, 466, 49/41, 35; 404/25

[56] References Cited

UNITED STATES PATENTS

| | | | |
|---|---|---|---|
| 795,687 | 7/1905 | Cameron | 49/465 |
| 1,016,081 | 1/1912 | McNulty | 49/465 |
| 1,131,327 | 3/1915 | Caldwell | 49/463 X |
| 1,165,804 | 12/1915 | Quigley | 49/465 |
| 1,610,123 | 12/1926 | Fairweather | 49/465 X |
| 1,721,831 | 7/1929 | Porter | 49/465 X |
| 1,877,996 | 9/1932 | Shanley | 49/465 |

*Primary Examiner*—Philip C. Kannan

*Attorney, Agent, or Firm*—Wenderoth, Lind & Ponack

[57] ABSTRACT

A man-hole assembly includes a man hole cover, a surrounding frame, a housing in the frame, a projection provided in the cover and extending into the housing when the cover is mounted in the frame to close the man hole and a key for locking the projection in the housing. The key includes an upper plate and a parallelopipedic foot connected to the plate by a stem, the plate being provided on its short sides with downwardly-extending flanges.

6 Claims, 8 Drawing Figures

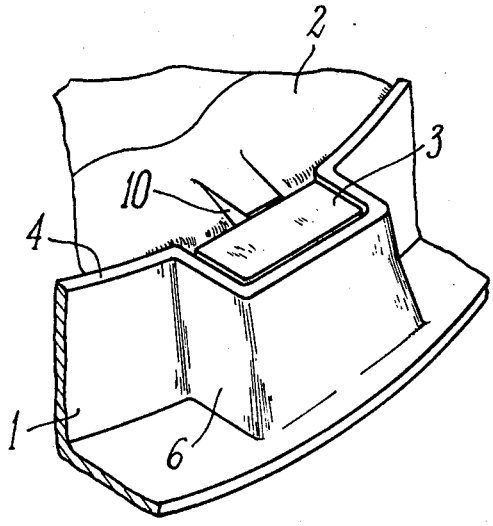
FIG. 1
FIG. 2
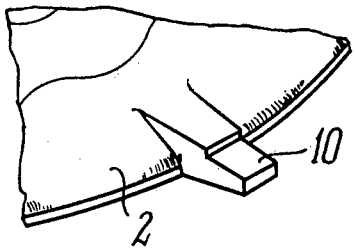
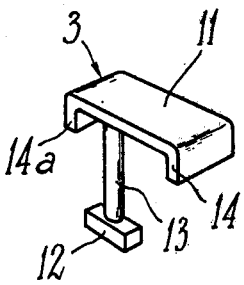
FIG. 4
FIG. 3
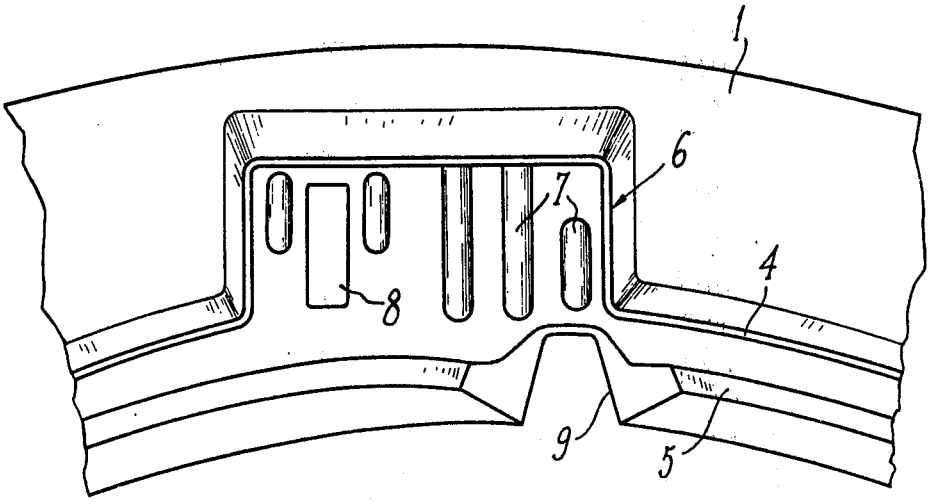

MAN-HOLE ASSEMBLY

BACKGROUND OF THE INVENTION

The present invention relates to man holes and more particularly to mounting and locking of man hole covers in frames surrounding the man holes.

There are known man holes formed of a frame on which is mounted a cover which is closed on the frame by screws. These screws are usually but not necessarily projections integral with the cover acting on inclined members of the frame, rotation of the cover in the closing direction having as its effect the bringing together of the cover and the frame and formation of a connection between the two.

It is desirable for covers of this type, and generally in all cases where the cover is movable in rotation with respect to the frame, to provide a device for locking the cover in a given position.

In the case of covers which are closed by rotation, such locking is particularly desirable in that it allows the cover to be maintained closed and thus avoids any rotation in the opening direction which might be caused by vibrations and repeated passage of vehicles. Such locking is especially important in the case of covers intended for roads which have to bear large numbers of heavy loads.

It is also desirable to prevent the locking means from causing the surface of the road, which includes the cover when in position, to have roughness or cavities which may be dangerous for traffic and may have bad effects on the tires of vehicles.

SUMMARY OF THE INVENTION

Consequently the present invention relates to a man hole assembly comprising a man hole cover, a surrounding frame for receiving the cover, and means for locking the cover in the frame. The cover and frame are provided respectively with at least one projection and a corresponding housing, the projection extending into the housing when the cover is mounted in the frame to close the man hole. The locking of the projection in the housing is carried out by means of a key which comprises a substantially rectangular flat upper plate and a parallelopipedic foot attached to the plate by a stem, the plate being provided on its short sides with downwardly-extending flanges.

BRIEF DESCRIPTION OF THE DRAWINGS

A preferred embodiment of the invention will be described by way of example with reference to the accompanying drawings, in which:

FIG. 1 is a perspective view of a part of a man hole showing a locking device incorporating a key locking a man hole cover in its frame, FIG. 2 is a perspective view of part of the cover of FIG. 1, FIG. 3 is a view from above of part of the frame of FIG. 1, FIG. 4 is a perspective view of the locking key of FIG. 1, and FIGS. 5 to 8 illustrate different operations necessary for locking of the cover in the frame of FIG. 1.

DETAILED DESCRIPTION OF THE INVENTION

Figure 5:
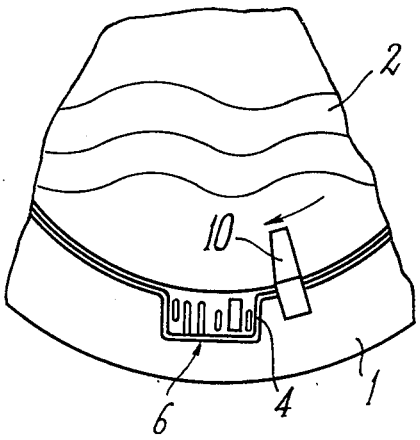

In the embodiment shown in FIGS. 1 to 4 the locking device of the invention is applied to a street man hole of the type including a frame 1 receiving a cover 2, the locking of the cover in the frame being carried out by means of a key 3.

The frame 1 comprises a peripheral flange 4 around the hole intended for receiving a circular cover 2 which rests on an annular shoulder 5 of the frame 1. The edge 4 has therein an exteriorly extending housing or locking box 6. The bottom of the housing 6 is provided with grooves 7 and a generally rectangular orifice 8. Internally thereof, the frame 1 has a gap 9 allowing passage of a locating foot of known type extending downwardly from the cover.

The cover 2 is of the circular type and may be provided in its plane with curves and projections of any type. Cover 2 is provided at its periphery with a locking projection 10 which is lodged in the box 6 of the frame 1.

Figure 7:
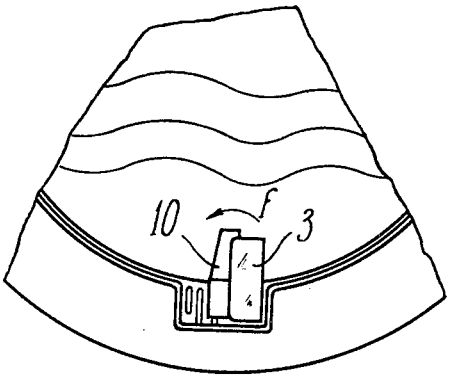
Figure 8:
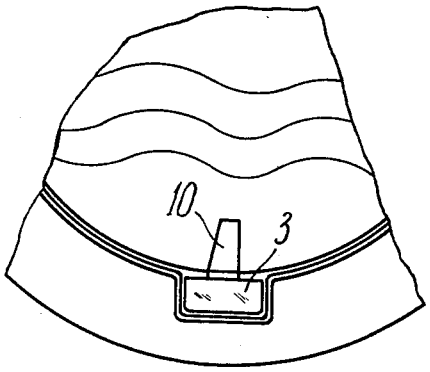

The locking key 3 (FIG. 4) comprises an upper flat plate 11 of substantially rectangular shape, and the two corners on one of the longer sides are advantageously rounded, as shown in FIGS. 7 and 8. The key 3 is provided with a parallelopipedic foot 12 connected to the plate 11 by a downwardly extending stem 13 which may for example be cylindrical. The dimensions of the foot 12 are such that it may pass through the orifice 8 of the box 6.

The two smaller sides of the plate 11 are provided with two downwardly extending vertical flanges 14, **14*a*, which are generally rectangular. The connection of the stem 13 to the plate 11 is effected adjacent the flange 14*a*. Key 3** may be a rough casting, the edges of the different parts thereof being slightly rounded to facilitate positioning of the key.

There will now be described with reference to FIGS. 5 to 8 the mounting and locking of the cover in the frame 1.

Figure 6:
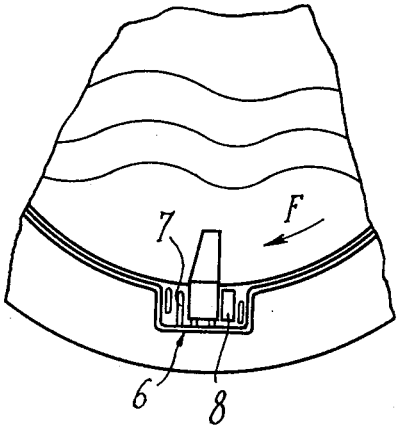

The cover 2 is positioned above the frame (FIG. 5) the projection 10 being positioned above the edge 4 of the frame. By rotation of the cover in the direction of the arrow F the projection 10 enters the housing 6. The cover is then in such a position that its further rotation causes its closure (for example lower closure projections, not shown, attached to the cover engaging the lower inclined surfaces of the frame) at the position shown in FIG. 6. Rotation of the cover to this position is advantageously effected by a lever acting on the grooves 7 or on the edges of the housing 6. When the cover is in its closed position, the hole 8 is exposed and the cover is closed but not locked (FIG. 6).

The foot 12 of the locking key 3 may then be introduced into the orifice 8 and by rotation thereof by a quarter turn in the direction of the arrow *f* (FIG. 7) the edges of the upper plate 11 are positioned against the interior wall of the housing 6. The two flanges 14 and **14*a* of the key then rest on the bottom of the housing 6 (FIG. 8). The bases of the flanges 14, 14*a* may have a shape such that in contact with the bottom of the housing 6** they are perfectly stable.

To remove the key it is necessary to lift it, which may be achieved with any type of flat tool, and rotate it through a quarter of a turn in a direction reverse to the arrow *f* in such a manner as to disengage the foot 12.

The following advantages are obtained with the above-described arrangement.

Due to the use of the key 3 the cover 2 is locked against rotation, unwanted opening due to vibrations and contact caused by passage of vehicles being impossible.

Due to flanges 14, 14*a*, the key 3 rests on the bottom of the housing 6 in stable manner, the height of these flanges being such that the upper plate 11 of the key is slightly below the level of the upper edge of the housing 6. This allows the part of the frame at which the housing is located to avoid having a road surface which is rough or pot-holed. Moreover, due to this characteristic, there is not complete contact with the tyres of vehicles which pass over the cover and the key cannot be removed.

The key is sturdy and of simple shape and may be a rough casting. Positioning of the key is easy and rapid.

Because of the presence of the foot 12 and its mounting in place by a quarter turn, there is no likelihood of ejection of this key.

The locking key may be raised from below if necessary, which may allow any person accidentally imprisoned below the man hole cover to escape.

In another embodiment of this invention, applied to a man hole which is not provided with a locking box and in which the cover is not provided with a projection 10, the key 3 is positioned in a housing corresponding to the cover 2, the orifice 8 intended for passage of the foot of the key then being slightly displaced towards the centre of the frame. Locking is effected in the manner described above.

What is claimed is:

1. A man hole assembly comprising:

a man hole cover;

a man hole frame having an opening therein to receive said cover in a position closing said opening;

said frame having therein at least one outwardly recessed housing;

said cover having at least one outwardly extending projection, said projection extending into said housing when said cover is mounted in said frame to close said frame opening;

a locking key comprising:

an upper flat plate of substantially rectangular shape;

a parallelopipedic foot; and a stem connecting said foot to said plate;

said frame housing having a base with an orifice therein, said orifice being dimensioned to allow passage therethrough of said foot; and when said cover is mounted in said frame with said projection extending into said housing, said foot of said key being passed through said orifice, said key being rotated by substantially a quarter turn to a locked position whereat said cover is locked in said frame with edges of said upper plate against inner walls of said housing and said foot out of alignment with said orifice.

2. A man hole assembly as claimed in claim 1, wherein said upper plate has two opposite shorter side edges and two opposite longer side edges, said shorter side edges each having extending downwardly therefrom a flange, said base of said housing having grooves therein, and when said key is in said locked position bottom edges of said flanges being received in said grooves.

3. A man hole assembly as claimed in claim 1, wherein said orifice and said foot are both of similar elongated rectangular shape when viewed in plan, said foot passing through said orifice when aligned therewith, but abutting said housing when said key is in said locked position.

4. A man hole assembly as claimed in claim 1, wherein when said cover is mounted in said frame to close said opening and when said key is in said locked position, said projection abuts said stem, thereby preventing rotation of said cover.

5. A man hole assembly as claimed in claim 1, wherein said upper plate is dimensioned to be completely received in said housing when said key is in said locked position.

6. A man hole assembly as claimed in claim 1, wherein said upper plate has flanges depending downwardly from two opposite side edges thereof, said flanges being dimensioned such that when said key is in said locked position the upper surface of said upper plate is at a level below the upper edge of said housing.

* * * * *